United States Patent [19]

Cecere et al.

[11] 4,003,216

[45] Jan. 18, 1977

[54] EARRING STRUCTURE

[76] Inventors: Anthony Robert Cecere, 60 Fox Place, Hicksville, N.Y. 11801; William McTighe, 220 E. 17th St., New York, N.Y. 10003

[22] Filed: Mar. 18, 1976

[21] Appl. No.: 667,913

[52] U.S. Cl. ..... 63/12; 24/85 R; 63/14 D

[51] Int. Cl.[2] ..... A44C 7/00

[58] Field of Search ..... 63/14 R, 14 F, 14 B, 63/14 G, 14 C, 12, 14 D, 13, 14 E; 24/85, 157

[56] References Cited

UNITED STATES PATENTS

| | | | |
|---|---|---|---|
| 2,416,588 | 2/1947 | Martin | 63/14 C |
| 2,501,754 | 3/1950 | Battiste | 63/14 D |
| 2,510,250 | 6/1950 | Pereira et al. | 24/85 R |
| 2,813,407 | 11/1957 | Arzt | 63/14 D |
| 3,122,007 | 2/1964 | Horland | 63/12 |

*Primary Examiner*—F. Barry Shay
*Attorney, Agent, or Firm*—Wolder & Gross

[57] ABSTRACT

An earring structure for use with both pierced and non-pierced ears including a generally U-shaped main body member at one end of which is rotatably attached a pivotal post and at the other end of which is rotatably attached a pressure member. The pivotal post can assume a position which merely extends the one end of the main body member when the earring is being used with a non-pierced earlobe. Both of the pressure member and the one end of the main body member define opposed relatively flat surfaces which hold the earlobe therebetween for non-pierced use and the pressure member defines an aperture for receiving the pivotal post for pierced use of the structure. The pivotal post is rotatable to a position perpendicular to the planar surfaces for pierced use.

5 Claims, 7 Drawing Figures

FIG. 1
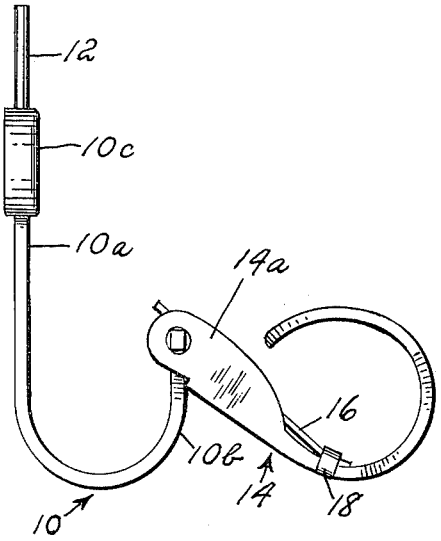
FIG. 2
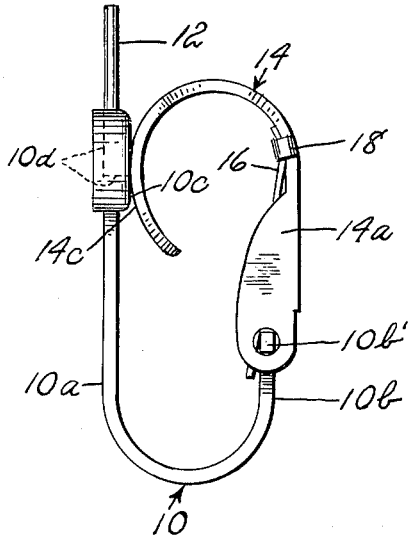
FIG. 3
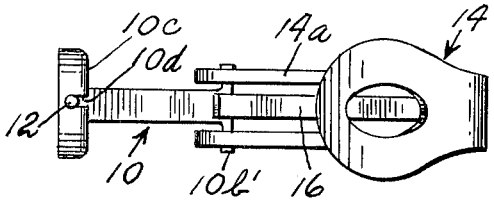
FIG. 4
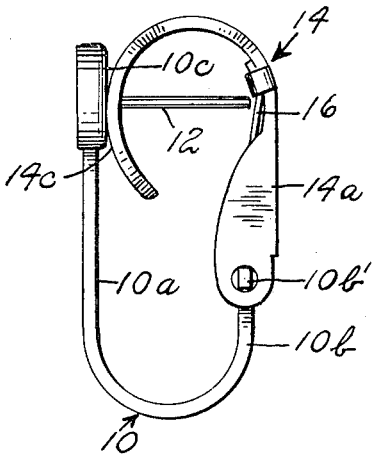
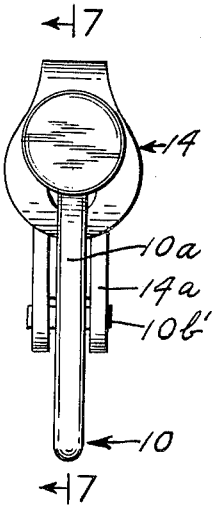
FIG. 6
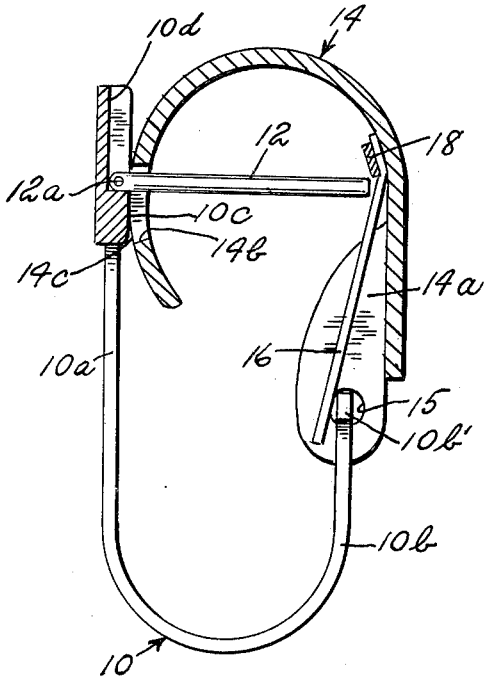
FIG. 7
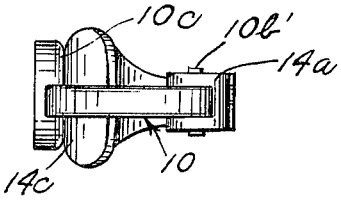
FIG. 5

EARRING STRUCTURE

This invention relates primarily to the jewelry field and more particularly, it relates to convertible jewelry, specifically earrings, whereby an earring structure is suitable for use both with pierced earlobes and non-pierced earlobes.

Convertible jewelry is not unknown to the ornamentation art. For instance, many earrings have been structured to double as ornamental pins. In such cases, however, the structure is usually inclusive of a removable pin member to avoid discomfort of the wearer when the structure is functioning as an earring. Furthermore, use of pivotal posts in earrings is not unknown to the art. Such posts have been used in order to provide storage convenience for earrings engageable with pierced ears.

Nevertheless, the concept of combination use earrings, adaptable to both pierced and non-pierced earlobes is relatively unknown to this day. The problems associated with such structures have been difficult to overcome. As an example, it is essential that all earring structures be comfortable for the wearer. Proposed combination use structures have proven to be cumbersome and uncomfortable for the wearer and have therefore not been adopted.

Likewise, it is essential that combination use structures be relatively simple and convenient for the user to operate. It is also important that such structures be efficient in their use of precious material and yet reliable.

Accordingly, a primary object of the present invention is to provide a combination use ornamentation structure which provides an earring both for pierced and non-pierced ears.

A still further object of the present invention is to provide an earring structure for use with both pierced and non-pierced ears which is reliable, simple, convenient to use and efficient in its use of materials.

These and other objects of the present invention are accomplished by the present invention which features an earring structure including a generally U-shaped main body member. One end of the U-shaped structure of the main body member is rotatably attached to a pivotal post, which in its vertical position rests in a groove defined by a planar surface of the one end. The pivotal post is also capable of assuming a position perpendicular to the surface of the one end for use of the structure with pierced ears. The other end of the U-shape is rotatably attached to a pressure member, also defining a smooth surface, which can assume a position opposed to the planar surface of the one end previously mentioned. The pressure member is also capable of assuming a position perpendicular to the opposed surfaces for removing the earring and for beginning a motion towards its other position, whereby the pivotal post is inserted to an aperture defined by the smooth surface of the pressure member.

In other words, the structure provided for a non-pierced ear includes a generally U-shaped main body member, with one of its ends extended by a pivotal post recessed in a groove defined by the surface of the one end; the other end of the main body member is rotatably connected to a pressure member, also defining a smooth surface for bearing against the non-pierced earlobe, which rests against the smooth surface of the one end. On the other hand, use of the structure with a pierced earlobe provides a pivotal post extending perpendicularly from a smooth surface of one end of the U-shaped main body and insertion of the post through an aperture in a pressure member rotated in the same way to bear against the lobe.

In either case, a spring is provided with the pressure member to enable two stop positions, the first of which is generally perpendicular to the smooth surface of the one end and a second position whereby the two smooth surfaces are in a position opposed to each other.

The above brief description, as well as further objects, features and advantages of the present invention will be more fully appreciated by reference to the following detailed description of the preferred, but nonetheless illustrative embodiment when taken in conjunction with the accompanying drawings, wherein:

FIG. 1 is a front view of an earring structure according to the present invention, with the pivotal post threeof in a position for use with a non-pierced ear and with the pressure member thereof rotated to its open position;

FIG. 2 is a representation similar to that of FIG. 1, but with the pressure member rotated to a closed position as it would assume when worn;

FIG. 3 is a top view of the structure of FIG. 2;

FIG. 4 is a front view of an earring structure according to the present invention, but with the pivotal post thereof rotated to a position for use with pierced earlobes and with the pressure member thereof rotated to a position it assumes when worn with the pivotal post inserted through an aperture defined by the smooth surface of the pressure member;

FIG. 5 is a bottom view of the structure of FIG. 4;

FIG. 6 is a left side elevational view of the structure of FIG. 4; and,

FIG. 7 is a front sectional view taken along the line 7—7 of FIG. 6 and showing particularly the spring of the pressure member and the insertion of the pivotal post through an aperture defined by the smooth surface of the pressure member.

Referring to the drawings, and particularly FIGS. 1 through 3 thereof, an earring structure is shown to include a main body member 10, which is generally of a U-shape. One leg **10*a* of the main body member terminates in a structure defining a relatively flat smooth surface 10*c*. Smooth surface 10*c*, in turn, defines groove 10*d*, into which is rotatably attached pivotal post 12. Actually, this pivotal attachment is made by the use of a transverse slot (not shown) at the base of groove 10*d* and the insertion into that slot of arms 12*a* (FIG. 7) arranged perpendicularly to the extension of pivotal post 12. The back and bottom walls of groove 10*d* (FIG. 2) are thereby provided to act as stops for pivotal post 12** as it is rotated from a first position shown in FIG. 1 to a second position illustrated in FIGS. 4 through 7.

The other leg **10*b* of main body member 10 terminates in a rotatable connection of a pressure member, generally designated 14. This rotatable connection is best illustrated by reference to FIG. 7 wherein it is shown that the second leg 10*b* of main body member 10 terminates in a T-shaped structure with extending arms 10*b'*. Such arms 10*b'* extend transversely into an opening 15 defined by pressure plate 14*a* as a part of pressure member 14. Spring 16 is attached by brackets 18 or the like to pressure member 14 to bear against the rotatable connection. Also, pressure member 14 defines an aperture 14*b*** whose function will be described with more particularity with reference to FIGS. 4 through 7. Furthermore, pressure member 14 terminates in a substantially smooth relatively flat surface 14*c*. Therefore, pressure member 14 is capable of assuming two positions as illustrated respectively in FIGS. 1 and 2. The first position is with pressure member 14 generally perpendicular to planar surface 10*c* defined by the end of the first leg 10*a* of the main body member (FIG. 1). The second position is with surfaces 10*c*, 14*c* in an opposed relationship. This latter position is, of course, the closed position of the earring and is the position assumed when the earring is being worn in non-pierced ears. It should be particularly noted, with respect to FIGS. 1 through 3, that the earring, when worn with non-pierced ears, is extremely comfortable for the wearer with opposed surfaces 10*c*, 14*c* providing a comfortable arrangement for the earlobe. Pivotal post 12 is seated well within groove 10*d* so as not to promote discomfort for the wearer.

Referring now to FIGS. 4 through 7, an earring according to the present invention is shown converted to one usable with pierced earlobes. It may be seen in these figures that pivotal post 12 has been rotated to a position perpendicular to planar surface 10*c*. Its insertion through aperture 14*b* is accomplished simply by moving pivotal post 12 to this position and thereafter rotating pressure member 14 from a position similar to that shown in FIG. 1 to a position similar to that shown in FIG. 2. In this way, pivotal post 12 is automatically inserted through aperture 14*b*.

In order to provide a more complete description of the present invention, a series of use and operational steps will not be described with reference to all drawings. Assuming first of all that the wearer desires to wear the earring structure with non-pierced ears, the present invention is manipulated to a position represented by FIG. 1. That is, pressure member 14 is rotated to a position generally perpendicular to planar surface 10*c*. Furthermore, pivotal post 12 is rotated to a position generally extending the line of the first leg 10*a* of main body member 10. Main body member 10 is then placed in a position with respect to the ear so that it generally encircles the bottom of the earlobe with its first leg 10*a* behind the ear and the second leg 10*b* in front of the ear. For added comfort, the planar surface 10*c* should then rest behind the ear and near the top part of the earlobe. Pressure member 14 is then rotated to the position shown in FIG. 2 whereby surfaces 10*c*, 14*c* are generally opposed.

Removal of the earring for this use is accomplished by rotating pressure member 14 to a position represented by FIG. 1 and simply lowering the earring structure.

Assuming now that the wearer desires to use the earring structure in pierced ears, the structure is manipulated to a position generally as illustrated in FIG. 1, but with pivotal post 12 rotated to a position generally perpendicular to planar surface 10*c*. The earring is then placed again with planar surface 10*c* generally near the back and top of the earlobe and pivotal post 12 is inserted through the pierced opening in the earlobe so that it projects forward thereof on the front face of the ear. Pressure member 14 is then rotated to a position represented in FIGS. 4 and 7 so that pivotal post 12 also projects through aperture 14*b*.

Removal of the earring from this position in a pierced ear is accomplished simply by rotating pressure member 14 to its position as shown in FIG. 1, pulling pivotal post 12 backwardly of the ear and lowering the earring structure.

It may be seen from the above that a convenient, reliable and simple structure is provided for accomplishment of the objectives of the present invention. With either pierced or non-pierced ears, the structure is comfortable for the wearer and convenient with respect to manipulating the structure to convert from one use to the other.

What is claimed is:

1. An earring structure for use with pierced and non-pierced ears comprising a generally U-shaped main body member, a pivotal post rotatably attached to one end of said main body member and a pressure member defining an aperture rotatably attached at the other end of said main body member, said main body member being arranged and adapted to encircle the lower portion of said ear, said one end for rising along one face of said ear and said other end for rising along the other face of said ear, said pivotal post standing up from and generally continuing said one end and said pressure member bearing against said other face when used with a non-pierced ear and said pivotal post extending through said aperture and ear when used with a pierced ear.

2. The invention according to claim 1 wherein each of said one end and said pressure member define opposed, relatively flat surfaces for wearing with said ear therebetween.

3. The invention according to claim 2 wherein said pressure member includes a spring for holding said pressure member in a first position perpendicular to said surface of said one end and in a second position with said surfaces generally parallel.

4. The invention according to claim 3 wherein said aperture is defined by said relatively flat surface of said pressure member, the structure being adapted and arranged to insert said pivotal post through said aperture when said pressure member is rotated from its perpendicular position as said post is used with a pierced ear in a position perpendicular to said planar surface of said one end.

5. The invention according to claim 2 wherein said one end further defines a post groove into which said post is inserted during use with a non-pierced ear such that ear irritation is avoided as said opposing surfaces are pressed towards each other.

* * * * *